US012789251B2

(12) United States Patent
Chou et al.

(10) Patent No.: US 12,789,251 B2
(45) Date of Patent: Nov. 10, 2026

(54) PERMANENT MAGNETIC ALLOY POWDER AND MANUFACTURING METHOD THEREOF

(71) Applicant: INDUSTRIAL TECHNOLOGY RESEARCH INSTITUTE, Hsinchu (TW)

(72) Inventors: Li-Shing Chou, Tainan City (TW); Yu-Hsien Chou, Tainan City (TW); Chi-San Chen, Kaohsiung City (TW)

(73) Assignee: INDUSTRIAL TECHNOLOGY RESEARCH INSTITUTE, Hsinchu (TW)

( * ) Notice: Subject to any disclaimer, the term of this patent is extended or adjusted under 35 U.S.C. 154(b) by 397 days.

(21) Appl. No.: 18/506,560

(22) Filed: Nov. 10, 2023

(65) Prior Publication Data

US 2025/0153241 A1 May 15, 2025

(51) Int. Cl.
*B22F 1/05* (2022.01)
*B22F 9/04* (2006.01)

(52) U.S. Cl.
CPC ..... *B22F 1/05* (2022.01); *B22F 2009/041* (2013.01); *B22F 2201/11* (2013.01);
(Continued)

(58) Field of Classification Search
CPC ..... B22F 1/05; B22F 1/14; B22F 2009/041; B22F 2201/11; B22F 2301/355;
(Continued)

(56) References Cited

U.S. PATENT DOCUMENTS 5,242,508 A 9/1993 McCallum et al.
5,589,009 A 12/1996 Kim et al.
(Continued)

FOREIGN PATENT DOCUMENTS

CN 1592940 A 3/2005
CN 1261265 C 6/2006
(Continued)

OTHER PUBLICATIONS

NPL: on-line translation of CN-114203379-A, Mar. 2022 (Year: 2022).*
(Continued)

*Primary Examiner* — Jie Yang
(74) *Attorney, Agent, or Firm* — Andrew M. Calderon; Calderon Safran & Wright P.C.

(57) ABSTRACT

A permanent magnetic alloy powder includes rare earth elements, iron, boron, aluminum, copper and carbides. The rare earth elements include neodymium, and account for 24 to 30 parts by weight. Iron accounts for 65 to 72 parts by weight. Boron accounts for 0.8 to 1.2 parts by weight. Cobalt accounts for 2.8 to 3.2 parts by weight. Aluminum accounts for 0.2 to 0.6 parts by weight. Copper accounts for 0.1 to 0.4 parts by weight. The carbides account for 0.1 to 0.4 parts by weight. The particle size of the permanent magnetic alloy powders is 10 μm to 70 μm, and the grain size of NdFeB phase in the permanent magnetic alloy powders is less than 5 μm. Through the selection of alloy material ratio and manufacturing process, the processability and formability of permanent magnetic alloy materials can be effectively improved, suitable for metal injection molding and 3D printing production.

4 Claims, 2 Drawing Sheets

(52) U.S. Cl.
CPC ... *B22F 2301/355* (2013.01); *B22F 2302/105* (2013.01); *B22F 2304/10* (2013.01)

(58) Field of Classification Search
CPC ..... B22F 2302/105; B22F 2304/10; B22F 2998/10; B22F 3/225; B22F 9/023; B22F 9/082; C22C 2202/02; C22C 33/0278; H01F 1/0573
See application file for complete search history.

(56) References Cited

U.S. PATENT DOCUMENTS

| | | | | |
|---|---|---|---|---|
| 7,147,686 | B2 * | 12/2006 | Tayu | H01F 1/09 148/101 |
| 7,261,781 | B2 | 8/2007 | Kanekiyo et al. | |
| 2002/0157733 | A1 | 10/2002 | Sellers et al. | |
| 2007/0102069 | A1 | 5/2007 | Hidaka et al. | |
| 2010/0068512 | A1 * | 3/2010 | Imaoka | C01B 21/0602 252/62.51 R |
| 2015/0364234 | A1 | 12/2015 | Nagata et al. | |
| 2019/0096550 | A1 * | 3/2019 | Kuniyoshi | H01F 1/0577 |

FOREIGN PATENT DOCUMENTS

| | | | | | |
|---|---|---|---|---|---|
| CN | 1810998 | A | | 8/2006 | |
| CN | 1974822 | A | | 6/2007 | |
| CN | 102205417 | A | | 10/2011 | |
| CN | 102360920 | B | | 2/2013 | |
| CN | 102496440 | B | | 7/2013 | |
| CN | 114203379 | A | * | 3/2022 | H01F 1/0557 |
| CN | 115244206 | A | | 10/2022 | |
| JP | 2002144328 | A | * | 5/2002 | H01F 1/083 |
| TW | 179154 | | | 2/1992 | |
| TW | 200535873 | A | | 11/2005 | |
| TW | 201405594 | A | | 2/2014 | |
| TW | I608500 | B | | 12/2017 | |

OTHER PUBLICATIONS

NPL: on-line translation of JP-2002144328-A, May 2002 (Year: 2002).*

A.S. Volegov et al., "Additive manufacturing of heavy rare earth free high-coercivity permanent magnets", Acta Materialia, vol. 188, 2020, pp. 733-739, 7 pages; https://doi.org/10.1016/j.actamat.2020.02.058.

X. Jing et al., "Influence of Solidification Rate on Microstructures of Cast Strips and Corresponding Sintered NdFeB Magnets", Journal of Rare Earths, vol. 24, Issue 1, Supplement 1, 2006, pp. 306-309, 4 pages; https://doi.org/10.1016/S1002-0721(07)60387-1.

B. Ma et al., "Effects of HDDR treatment on structure, morphology and particle size of Nd—Fe—B powders prepared by ball milling of Nd—Fe—B strip cast alloys", Journal of Magnetism and Magnetic Materials, vol. 519, Feb. 2021, 167417, 8 pages; https://doi.org/10.1016/j.jmmm.2020.167417.

X. D. Xu et al., "Origin of the coercivity difference in Nd—Fe—B sintered magnets processed from hydrogenation-disproportionation-desorption- recombination powder and jet-milled powder", Acta Materialia, vol. 151, 2018, pp. 293-300, 8 pages; https://doi.org/10.1016/j.actamat.2018.03.06.

S. Namkung et al., "Effect of Particle Size Distribution on the Microstructure and Magnetic Properties of Sintered NdFeB Magnets", Reviews on Advanced Materials Science, vol. 28, Issue 2, Jul. 2011, pp. 185-189, 5 pages.

T. Hattori et al., "Microstructural Evaluation of Nd—Fe—B Strip Cast Alloys", Material Transactions, vol. 50, Issue 3, Mar. 2009, pp. 479-482, 4 pages. DOI:10.2320/matertrans.MBW200821.

J. Wang et al., "The characteristic of crystal growth of Nd—Fe—B cast strips during the rapid solidification process", Journal of Magnetism and Magnetic Materials, vol. 396, 2015, pp. 283-287, 5 pages. https://doi.org/10.1016/j.jmmm.2015.08.004.

Examination report dated May 31, 2024, listed in related Taiwan patent application No. 112143560, 8 pages.

* cited by examiner (a)

(b)

PERMANENT MAGNETIC ALLOY POWDER AND MANUFACTURING METHOD THEREOF

TECHNICAL FIELD

The present disclosure relates to the field of magnetic materials, in particular to a permanent magnetic alloy powder and a manufacturing method thereof.

BACKGROUND

In recent years, with the increasing demand for environmental protection, the European Union has also formulated carbon tax and other related systems, prompting industrial powers to use green electricity to reduce greenhouse emissions, thereby increasing the demand for products such as wind power and electric vehicle motors. The magnets used in these products have high requirements for magnetic properties, especially for intrinsic coercivity (represented by Hcj) and maximum energy product (represented by BHmax).

Rare earth permanent magnetic alloy powders and permanent magnets are the largest industries in the application of rare earth materials, and neodymium-iron-boron (Nd—Fe—B) permanent magnetic materials are also widely used. However, due to the limitation of the particle size of neodymium-iron-boron (Nd—Fe—B) materials in the manufacturing process, it is quite difficult to produce products with complex shapes and achieve their application properties. There is an urgent need to develop new neodymium-iron-boron permanent magnetic alloy powders to be suitable for metal injection molding (MIM) or 3D printing processes and achieve materials with application properties.

SUMMARY

The present disclosure provides a permanent magnetic alloy powder, including a rare earth element, iron (Fe), boron (B), aluminum (Al), copper (Cu) and a carbide. The rare earth element includes neodymium (Nd), and accounts for 24 to 30 parts by weight; iron accounts for 65 to 72 parts by weight; boron accounts for 0.8 to 1.2 parts by weight; cobalt accounts for 2.8 to 3.2 parts by weight; aluminum accounts for 0.2 to 0.6 parts by weight; copper accounts for 0.1 to 0.4 parts by weight; and the carbide includes hafnium carbide (HfC), and accounts for 0.1 to 0.4 parts by weight. A particle size of the permanent magnetic alloy powders is 10 μm to 70 μm, and a grain size of NdFeB phase in the permanent magnetic alloy powders is less than 5 μm.

Here, the present disclosure further provides a method for manufacturing a permanent magnetic alloy powder, including: preparation of raw materials, gas atomization, hydrogenation and disproportionation, and desorption treatment. Raw materials include a rare earth element, iron, boron, aluminum, copper and a carbide. The rare earth element includes neodymium, and accounts for 24 to 30 parts by weight; iron accounts for 65 to 72 parts by weight; boron accounts for 0.8 to 1.2 parts by weight; cobalt accounts for 2.8 to 3.2 parts by weight; aluminum accounts for 0.2 to 0.6 parts by weight; copper accounts for 0.1 to 0.4 parts by weight; and the carbide includes hafnium carbide, and accounts for 0.1 to 0.4 parts by weight.

Then, a molten alloy raw material is atomized and granulated using a gas atomization method to obtain multiple permanent magnetic alloy primary powders. A hydrogenation and disproportionation treatment is performed on the permanent magnetic alloy primary powders. Finally, after the hydrogenation and disproportionation, a desorption treatment is performed on the permanent magnetic alloy primary powders in an inert protective gas to obtain multiple permanent magnetic alloy powders, a particle size of the permanent magnetic alloy powders ranges from 10 μm to 70 μm, and a grain size of NdFeB phase of the permanent magnetic alloy powders is less than 5 μm.

As shown in the above examples, through the selection of alloy material ratio and manufacturing process of the permanent magnetic alloy powder, permanent magnetic alloy powder with a small particle size and fine grains can be formed, and the processability and formability of permanent magnetic alloy materials can be effectively improved without reducing its magnetic properties, especially suitable for metal injection molding and 3D printing production, and capable of being applied to products with complex shapes.

DETAILED DESCRIPTION

Figure 1:
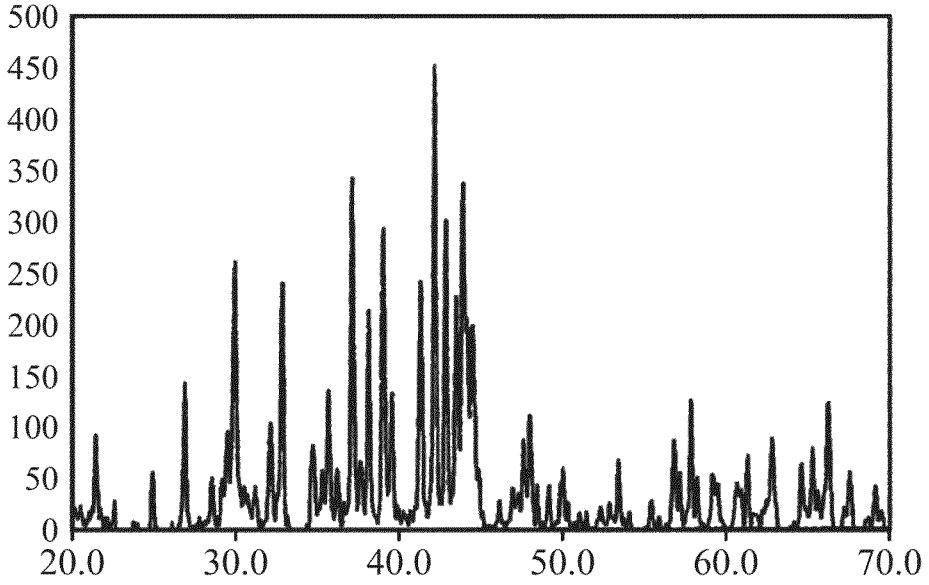
FIG. 1 shows a crystal phase comparison between a permanent magnetic alloy powder in Example 1 and that in a comparative example through X-ray diffraction analysis.
Figure 1:
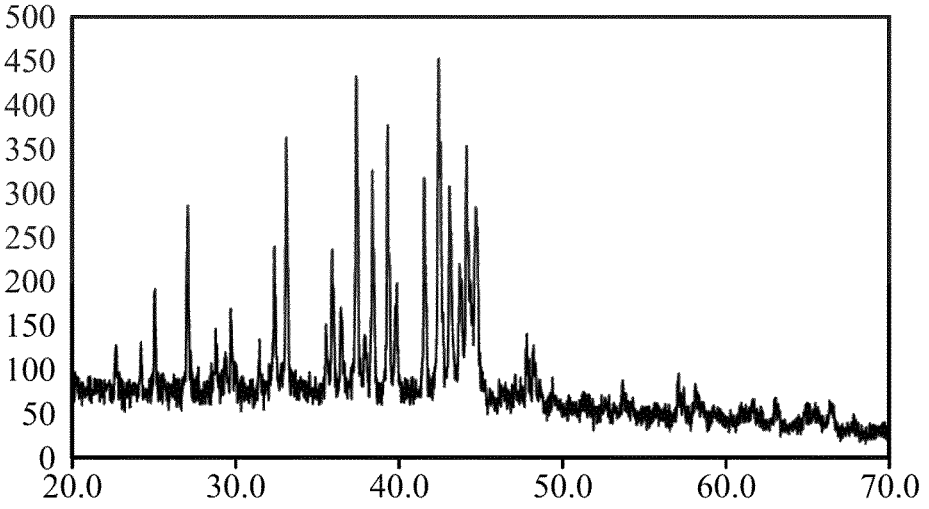

Current commercial and widely used permanent magnets are usually manufactured by strip casting process technology. The magnetic material is firstly casted into thin ribbons, and then grounded into fine powders. Then, the final product is completed through powder metallurgy and sintering. The current mainstream permanent magnetic alloy powder is neodymium-iron-boron (Nd—Fe—B) permanent magnetic alloy powder, which has relatively high magnetic properties and is widely used.

However, the current commercial neodymium-iron-boron permanent magnetic alloy powder has the issues of complex manufacturing process, large particle size, and irregular polygonal shape of the powder. Taking a practical example, the current commercial neodymium-iron-boron permanent magnetic alloy powder has a particle size range of about 100 μm to 300 μm. Due to limitations in particle size and shape, the current commercial permanent magnetic alloy powders are not suitable for metal injection molding (MIM) or 3D printing processes.

The inventor found that a method for forming products by powder sintering is quite difficult in mold making for products with complex shapes, and has many control factors in the process and relatively high costs. In addition, it is easy to cause grain growth due to the high temperature of sintering, leading to the problem of mechanical strength of subsequent products not meeting the requirements. Therefore, the formability and processability of commercial neodymium-iron-boron permanent magnetic alloy powder are significantly limited.

A method for manufacturing a permanent magnetic alloy powder includes preparation of raw materials, gas atomization, hydrogenation and disproportionation, and desorption treatment, in order to produce permanent magnetic alloy powder suitable for metal injection molding (MIM) and 3D printing, and to have appropriate magnetic properties through the selection of the steps of this manufacturing method.

Raw materials include a rare earth element, iron, boron, aluminum, copper and a carbide. The rare earth element accounts for 24 to 30 parts by weight, preferably 25 to 28 parts by weight. Iron accounts for 65 to 72 parts by weight, preferably 68 to 71.5 parts by weight. Boron accounts for 0.8 to 1.2 parts by weight, preferably 0.95 to 1.05 parts by weight. Cobalt accounts for 2.8 to 3.2 parts by weight, preferably 2.95 to 3.05 parts by weight. Aluminum accounts for 0.2 to 0.6 parts by weight, preferably 0.3 to 0.5 parts by weight. Copper accounts for 0.1 to 0.4 parts by weight, preferably 0.1 to 0.3 parts by weight. The carbide accounts for 0.1 to 0.4 parts by weight, preferably 0.1 to 0.3 parts by weight. In this embodiment, neodymium is used as the rare earth element, with neodymium-iron-boron as the main permanent magnetic alloy component. After the raw material ratio is completed, the materials are mixed and melted in a crucible.

Here, the effects of other trace additives are explained in detail. The addition of cuprum can mainly reduce the grain size of the NdFeB phase, reduce the precipitation of the soft magnetic a-Fe phase, improve the intrinsic coercivity, remanence (represented by Br) and thermal stability, as well as inhibit the formation of non-magnetic phases at grain boundaries. Here, NdFeB phase refers to various magnetic intermetallic phases of Nd—Fe—B, such as $Nd_2Fe_{14}B$.

The carbide includes hafnium carbide (HfC), which is added in the form of carbides rather than metal hafnium or carbon. The main reason for this is that the hafnium carbide has a relatively high melting point and thermal stability, and maintains the presence of carbides during melting, thereby avoiding the formation of unnecessary $Nd_2Fe_{14}C$ or $Nd_2C_3$ phases. The hafnium carbide can also be replaced with a small amount of silicon carbide (SiC), for example, the ratio of silicon carbide to hafnium carbide is 1:20. The purpose of adding carbides is to disperse their particles along grain boundaries, which can inhibit crystal growth and help control the grain size of NdFeB phase, forming equiaxed grains and increasing intrinsic coercivity.

Then, molten alloy raw materials are atomized and granulated using a gas atomization method, and then rapidly cooled from the molten state (about 1550-1700° C.) to room temperature at a cooling rate of about $10^{4-5}$° C./s. In this way, multiple small permanent magnetic alloy primary powders are obtained.

Next, the permanent magnetic alloy primary powders are placed in a hydrogen atmosphere and subjected to a hydrogenation and disproportionation treatment. Hydrogen is allowed to enter the pores of the powder and undergoes a reduction reaction. Preferably, the hydrogenation and disproportionation is carried out at an operating temperature of 800° C. to 1000° C. and an operating pressure of 0.1 MPa to 0.3 MPa for 0.5 to 2 hours. However, according to the actual needs of implementation, it can be adjusted, and the above is only an example, not a limitation.

Finally, after the hydrogenation and disproportionation, a desorption treatment is performed on the permanent magnetic alloy primary powders in an inert protective gas (such as helium, neon, or argon) to obtain multiple permanent magnetic alloy powders. Preferably, the operation lasts 0.5 to 2 hours.

Through particle size analysis and scanning electron microscopy, and combined with energy scattering spectroscopy and particle size analysis in permanent magnetic alloy powder, the particle size of the permanent magnetic alloy powder ranges from 10 μm to 70 μm, and the grain size of the NdFeB phase is less than 5 μm. In addition, in conjunction with X-ray photoelectron spectroscopy (XPS) to detect the composition of the powder, the proportion of the powder components should be consistent with the aforementioned raw material proportion.

Through hydrogenation and disproportionation, hydrogen can penetrate into the permanent magnetic alloy primary powder, achieving the effect of reducing the alloy. During further desorption treatment, impurities such as hydrogen in the permanent magnetic alloy primary powders and oxygen incorporated in the process are further removed due to the removal of hydrogen, achieving further fragmentation and refinement of the permanent magnetic alloy primary powder to obtain permanent magnetic alloy powders.

Here, 27 parts by weight of niobium, 72 parts by weight of iron, and 1 part by weight of boron (in the same proportion as the Nd—Fe—B permanent magnetic alloy powder of commercial Baotou steel N-50) are used as a comparative example for powder granulation compared to the above production method. In addition, Table 1 and Table 2 respectively list the comparison of the composition ratio (part by weight) and magnetic properties between the comparative example and the actual Examples 1-9. It should be noted that the following are only examples, and the trend of actual magnetic property changes can be determined by adjusting the proportion of the mixture, rather than limiting it.

TABLE 1

| | Nd | Fe | B | Co | Al | Cu | HfC |
|---|---|---|---|---|---|---|---|
| Comparative example | 27 | 72 | 1 | | | | |
| Example 1 | 27 | 68.2 | 1 | 3 | 0.4 | 0.2 | 0.2 |
| Example 2 | 27 | 68.3 | 1 | 3 | 0.4 | 0.1 | 0.2 |
| Example 3 | 27 | 68.1 | 1 | 3 | 0.4 | 0.3 | 0.2 |
| Example 4 | 27 | 68.4 | 1 | 3 | 0.2 | 0.2 | 0.2 |
| Example 5 | 27 | 68 | 1 | 3 | 0.6 | 0.2 | 0.2 |
| Example 6 | 27 | 68.3 | 1 | 3 | 0.4 | 0.2 | 0.1 |
| Example 7 | 27 | 68.1 | 1 | 3 | 0.4 | 0.2 | 0.3 |
| Example 8 | 24 | 71.2 | 1 | 3 | 0.4 | 0.2 | 0.2 |
| Example 9 | 29.8 | 65.4 | 1 | 3 | 0.4 | 0.2 | 0.2 |

TABLE 2

| | Remanence (T) | Intrinsic coercivity (kA/m) | Maximum energy product (kJ/m$^3$) |
|---|---|---|---|
| Comparative example | 0.94 | 750 | 115 |
| Example 1 | 1.15 | 1058 | 140 |
| Example 2 | 1.06 | 1027 | 132 |
| Example 3 | 1.07 | 1010 | 135 |
| Example 4 | 1.18 | 1023 | 132 |
| Example 5 | 1.05 | 1157 | 127 |
| Example 6 | 1.09 | 1162 | 121 |
| Example 7 | 0.95 | 920 | 106 |
| Example 8 | 1.02 | 1021 | 119 |
| Example 9 | 1.20 | 1035 | 128 |

As shown in Tables 1 and 2, compared to the comparative example, it is evident that Examples 1 to 9 show significant improvements in various magnetic properties.

Figure 2:
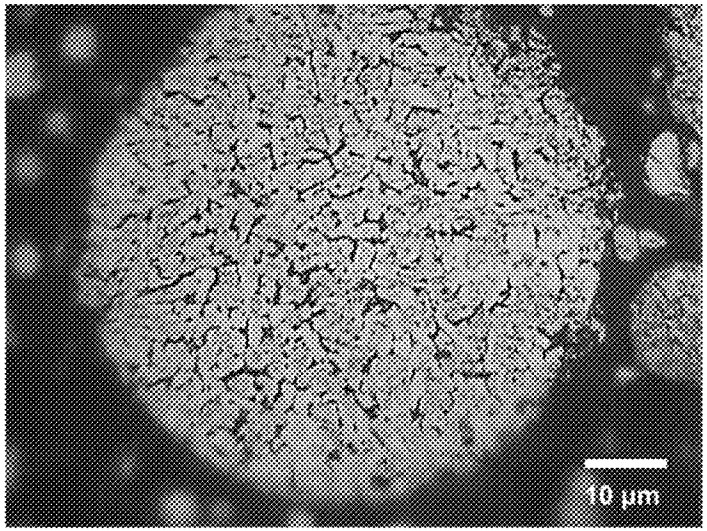
FIG. 2 shows a photo of a permanent magnetic alloy powder in Example 1 under a high magnification scanning electron microscope.

FIG. 1 shows a crystal phase comparison between a permanent magnetic alloy powder in Example 1 and that in a comparative example through X-ray diffraction analysis. FIG. 2 shows a photo of a permanent magnetic alloy powder in Example 1 under a high magnification scanning electron microscope. Through X-ray diffraction analysis in FIG. 1(*a*) and FIG. 1(*b*), there was no significant difference in the main peaks, indicating that the addition of trace amounts of alloy components did not affect the final crystalline phase of the overall powder.

In addition, through particle size analysis comparison, the median particle size distribution (D50) of the comparative example is about 35 μm, and the median particle size distribution (D50) of the permanent magnetic alloy powder in Example 1 is about 15 μm. It is determined that the above reasons infer that the addition of trace amounts of alloy components can refine the particle size of permanent magnetic alloy powders.

Through scanning electron microscopy observation, the grain size of the NdFeB phase in the comparative example is about 10 μm to 25 μm. At the same magnification of the scanning electron microscope, the grains of NdFeB phase in Example 1 cannot be clearly observed. Furthermore, as shown in FIG. 2, by increasing the magnification of the electron microscope, it can be observed that the grains of NdFeB phase are about less than 5 μm, ranging from 0.3 μm to 4 μm, and the grain size is finer compared to the comparative example. Moreover, it also shows that the permanent magnetic alloy powder in Example 1 is closer to the true circular shape, and the distribution of NdFeB phase is more uniform. In this way, it has been determined that the addition of trace alloy materials can further refine the crystal structure in permanent magnetic alloy powder, which is consistent with the previous thinking and results of material ratio.

The following will further compare the physical and magnetic properties of commercial Nd—Fe—B permanent magnetic alloy powder, which is subjected to strip casting and grinding granulation, with those of the comparative example and Example 1. The comparison results are shown in Table 3. Here, the commercial Nd—Fe—B permanent magnetic alloy powder used is Baotou steel N-50.

TABLE 3

| | Commercial Nd—Fe—B permanent magnetic alloy powder | Comparative example | Example 1 |
|---|---|---|---|
| Particle size (μm) | 100 to 300 | 10 to 70 | 10 to 20 |
| Nd—Fe—B phase grain size (μm) | 100 to 150 | 10 to 25 | <5 |
| Intrinsic coercivity (kA/m) | 960 | 750 | 1058 |
| Remanence (T) | 1.42 | 0.94 | 1.15 |
| Maximum energy product (kJ/m$^3$) | 390 | 115 | 140 |

As shown in Table 3, compared to conventional commercial Nd—Fe—B permanent magnetic alloy powders, the particle size can meet the requirements of MIM or 3D printing processes by gas atomization in the comparative example. However, there is a significant decrease in magnetic properties.

Example 1 shows that the addition of alloy materials can improve magnetic properties, especially intrinsic coercivity, and even surpass commercial Nd—Fe—B permanent magnetic alloy powders. Therefore, in addition to the significant improvement in processability and formability, the applicability is quite promising. It has feasibility in the future application in wind power and electric vehicles. Especially in implementing products with complex shapes, such as magnets with gear shapes, grooves, and teeth. Furthermore, for products with small volume, complex shape, and large batch production, they can have cost advantages due to their ability to reduce subsequent precision machining.

According to the present disclosure, through the selection of material ratio and manufacturing process, the permanent magnet alloy powder has small particle size and fine grains, which effectively improves the processing performance and molding performance. In addition, it is especially suitable for metal injection molding and 3D printing production, can be used to manufacture products with complex shapes and has greater potential application value.

Although the present disclosure has been described in considerable detail with reference to certain preferred embodiments thereof, the disclosure is not for limiting the scope of the instant application. Persons having ordinary skill in the art may make various modifications and changes without departing from the scope and spirit of the disclosure. Therefore, the scope of the appended claims should not be limited to the description of the preferred embodiments described above.

What is claimed is:

1. A method for manufacturing a permanent magnetic alloy powder, comprising:

providing a raw material comprising:

a rare earth element comprising neodymium, and accounting for 24 to 30 parts by weight;

iron accounting for 68 to 72 parts by weight;

boron accounting for 0.8 to 1.2 parts by weight;

cobalt accounting for 2.8 to 3.2 parts by weight;

aluminum accounting for 0.2 to 0.6 parts by weight;

copper accounting for 0.1 to 0.3 parts by weight; and a carbide comprising hafnium carbide, and accounting for 0.1 to 0.3 parts by weight;

atomizing and granulating a molten alloy raw material using a gas atomization method to obtain a plurality of permanent magnetic alloy primary powders;

performing a hydrogenation and disproportionation treatment on the permanent magnetic alloy primary powders; and after the hydrogenation and disproportionation, performing a desorption treatment on the permanent magnetic alloy primary powders in an inert protective gas to obtain a plurality of permanent magnetic alloy powders, a particle size of the permanent magnetic alloy powders ranging from 10 μm to 70 μm, and a grain size of NdFeB phase of the permanent magnetic alloy powders being 0.3 μm to 4, and wherein the hydrogenation and disproportionation is carried out at an operating temperature of 800° C. to 1000° C. and an operating pressure of 0.1 MPa to 0.3 MPa for 0.5 to 2 hours.

2. The method for manufacturing a permanent magnetic alloy powder according to claim 1, wherein the carbide further comprises silicon carbide.

3. The method for manufacturing a permanent magnetic alloy powder according to claim 1, wherein the particle size of the permanent magnetic alloy powder is 10 μm to 25 μm.

4. The method for manufacturing a permanent magnetic alloy powder according to claim 1, wherein in the desorption treatment, the protective gas is argon and the operation lasts for 0.5 to 2 hours.

* * * * *